US010066495B2

(12) United States Patent
Roberts et al.

(10) Patent No.: US 10,066,495 B2
(45) Date of Patent: Sep. 4, 2018

(54) ORGANIC MATRIX COMPOSITE STRUCTURAL INLET GUIDE VANE FOR A TURBINE ENGINE

(71) Applicant: United Technologies Corporation, Hartford, CT (US)

(72) Inventors: Steven Roberts, Moodus, CT (US); Kenneth F. Tosi, East Haddam, CT (US); Isaac J. Hogate, Meriden, CT (US); George A. Salisbury, East Hampton, CT (US)

(73) Assignee: United Technologies Corporation, Farmington, CT (US)

( * ) Notice: Subject to any disclaimer, the term of this patent is extended or adjusted under 35 U.S.C. 154(b) by 327 days.

(21) Appl. No.: 14/760,660

(22) PCT Filed: Jan. 14, 2014

(86) PCT No.: PCT/US2014/011473

§ 371 (c)(1),
(2) Date: Jul. 13, 2015

(87) PCT Pub. No.: WO2014/110569

PCT Pub. Date: Jul. 17, 2014

(65) Prior Publication Data

US 2015/0354380 A1 Dec. 10, 2015

Related U.S. Application Data

(60) Provisional application No. 61/752,255, filed on Jan. 14, 2013.

(51) Int. Cl.
*F01D 9/04* (2006.01)
*F01D 17/10* (2006.01)
(Continued)

(52) U.S. Cl.
CPC ..... *F01D 9/04* (2013.01); *F01D 5/147* (2013.01); *F01D 5/282* (2013.01); *F01D 9/042* (2013.01);
(Continued)

(58) Field of Classification Search
CPC . F01D 5/046; F01D 5/08; F01D 5/147; F01D 5/282; F01D 5/284; F01D 5/24; F01D 25/246; F01D 9/04; F01D 9/042
See application file for complete search history.

(56) References Cited

U.S. PATENT DOCUMENTS 2,819,871 A 1/1958 McVeigh
5,690,469 A 11/1997 Deal et al.
(Continued)

OTHER PUBLICATIONS

EP Search Report dated Mar. 8, 2016.

*Primary Examiner* — Woody Lee, Jr.
*Assistant Examiner* — Maxime Adjagbe
(74) *Attorney, Agent, or Firm* — O'Shea Getz P.C.

(57) ABSTRACT

An assembly for a turbine engine includes an inner platform, and outer platform and a plurality of structural inlet guide vanes. The outer platform circumscribes the inner platform. The structural inlet guide vanes are arranged around an axis, and extend radially between and are connected to the inner platform and the outer platform. A first of the structural inlet guide vanes includes a structural vane body that is configured from or otherwise includes an organic matrix composite.

19 Claims, 7 Drawing Sheets

(51) Int. Cl.

| | |
|---|---|
| ***F01D 25/24*** | (2006.01) |
| ***F01D 25/10*** | (2006.01) |
| ***F01D 5/14*** | (2006.01) |
| ***F01D 5/28*** | (2006.01) |
| *F01D 25/02* | (2006.01) |

(52) U.S. Cl.

CPC ..... *F01D 17/10* (2013.01); *F01D 25/10* (2013.01); *F01D 25/246* (2013.01); *F01D 25/02* (2013.01); *F05D 2220/30* (2013.01); *F05D 2300/224* (2013.01); *F05D 2300/2261* (2013.01); *F05D 2300/437* (2013.01); *F05D 2300/48* (2013.01)

(56) References Cited

U.S. PATENT DOCUMENTS

| | | | | |
|---|---|---|---|---|
| 6,223,524 | B1 * | 5/2001 | Durcan ..... | F01D 5/225 415/173.6 |
| 7,789,620 | B2 | 9/2010 | Vontell, Sr. et al. | |
| 7,942,632 | B2 | 5/2011 | Lord et al. | |
| 7,950,899 | B2 | 5/2011 | Euvino, Jr. et al. | |
| 8,006,934 | B2 | 8/2011 | Alexander et al. | |
| 8,049,147 | B2 | 11/2011 | Hogate | |
| 8,206,098 | B2 | 6/2012 | Prill et al. | |
| 8,231,958 | B2 | 7/2012 | Hoover et al. | |
| 8,247,746 | B2 | 8/2012 | Alexander et al. | |
| 8,257,030 | B2 | 9/2012 | Lyders et al. | |
| 8,312,726 | B2 | 11/2012 | Wong et al. | |
| 8,334,486 | B2 | 12/2012 | Hogate | |
| 2004/0062652 | A1 | 4/2004 | Grant et al. | |
| 2005/0076504 | A1 | 4/2005 | Morrison et al. | |
| 2006/0280600 | A1 | 12/2006 | Euvino et al. | |
| 2008/0185454 | A1 | 7/2008 | Vontell | |
| 2008/0226453 | A1 | 9/2008 | Nordeen et al. | |
| 2009/0243176 | A1 | 10/2009 | Alexander | |
| 2009/0260341 | A1 | 10/2009 | Hogate et al. | |
| 2010/0108661 | A1 | 5/2010 | Vontell et al. | |
| 2011/0206522 | A1 | 8/2011 | Alvanos et al. | |
| 2011/0229326 | A1 | 9/2011 | Papin et al. | |
| 2011/0243752 | A1 | 10/2011 | Duchaine | |
| 2012/0301285 | A1 | 11/2012 | Suciu et al. | |

* cited by examiner

ORGANIC MATRIX COMPOSITE STRUCTURAL INLET GUIDE VANE FOR A TURBINE ENGINE

This application is entitled to the benefit of, and incorporates by reference essential subject matter disclosed in PCT Application No. PCT/US14/11473 filed on Jan. 14, 2014, which claims priority to U.S. Patent Appln. No. 61/752,255 filed Jan. 14, 2013.

BACKGROUND OF THE INVENTION

1. Technical Field

This disclosure relates generally to a turbine engine and, more particularly, to a turbine engine assembly with one or more inlet guide vanes.

2. Background Information

A typical turbine engine includes a fan section, a compressor section, a combustor section and a turbine section. The engine may also include an inlet guide vane assembly that includes a plurality of guide vane fairings and a plurality of struts. The guide vane fairings guide a flow of gas into the fan section, and are fastened to the struts. The struts are arranged radially between and structurally tie together a vane inner platform and a vane outer platform. Each of the struts extends radially through a respective one of the guide vane fairings. The guide vane fairings therefore are typically sized relatively large in order to accommodate the struts therewithin. Such relatively large guide vane fairings may reduce the flow of air into the engine.

There is a need in the art for improved inlet guide vanes.

SUMMARY OF THE DISCLOSURE

According to an aspect of the invention, an assembly is provided for a turbine engine. The assembly includes an inner platform, an outer platform and a plurality of structural inlet guide vanes arranged around an axis. The outer platform circumscribes the inner platform. The structural inlet guide vanes extend radially between and are connected to the inner platform and the outer platform. A first of the structural inlet guide vanes includes a structural vane body that is configured from or otherwise includes an organic matrix composite.

The structural vane body may transfer loads between the inner platform and the outer platform.

A gas path may be defined radially between the inner platform and the outer platform. The structural vane body may guide gas through the gas path.

The structural vane body may include a core of the organic matrix composite. The core may be configured as or otherwise include a substantially solid core of the organic matrix composite.

The structural vane body may include a coating that at least partially coats the core.

The structural vane body may extend axially between a leading edge and a trailing edge. The structural vane body may include a heater located at the leading edge. The heater may be connected to the core.

The heater may include a heating element that is at least partially embedded within an insulator.

The structural vane body may include a coating that at least partially coats the heater.

The first of the structural inlet guide vanes may include a mount that fastens the structural vane body to the inner platform. The first of the structural inlet guide vanes may also or alternatively include a mount that fastens the structural vane body to the outer platform.

The structural vane body may extend radially between an inner end and an outer end. The mount may include a sleeve. The structural vane body may extend radially into the sleeve. The structural vane body may also or alternatively be fastened and/or adhered to the sleeve. The mount and/or the sleeve may be configured from or otherwise include metal.

The outer platform may include a vane aperture. The first of the structural inlet guide vanes may extend radially into the vane aperture.

The inner platform may include a vane aperture. The first of the structural inlet guide vanes may extend radially into the vane aperture.

The inner vane platform may include an axial first segment and an axial second segment that is fastened to the first segment. The vane aperture may be defined by the first segment and the second segment.

The organic matrix composite may be configured from or otherwise include graphite, silicon carbide and/or fiberglass.

The inner platform and/or the outer platform may be configured from or otherwise include metal.

The assembly may include a nosecone connected to the inner platform.

The assembly may include a plurality of adjustable inlet guide vanes that are respectively arranged with the structural inlet guide vanes. Each of the adjustable inlet guide vanes may rotate about a respective radially extending axis.

The foregoing features and the operation of the invention will become more apparent in light of the following description and the accompanying drawings.

DETAILED DESCRIPTION OF THE INVENTION

Figure 1:
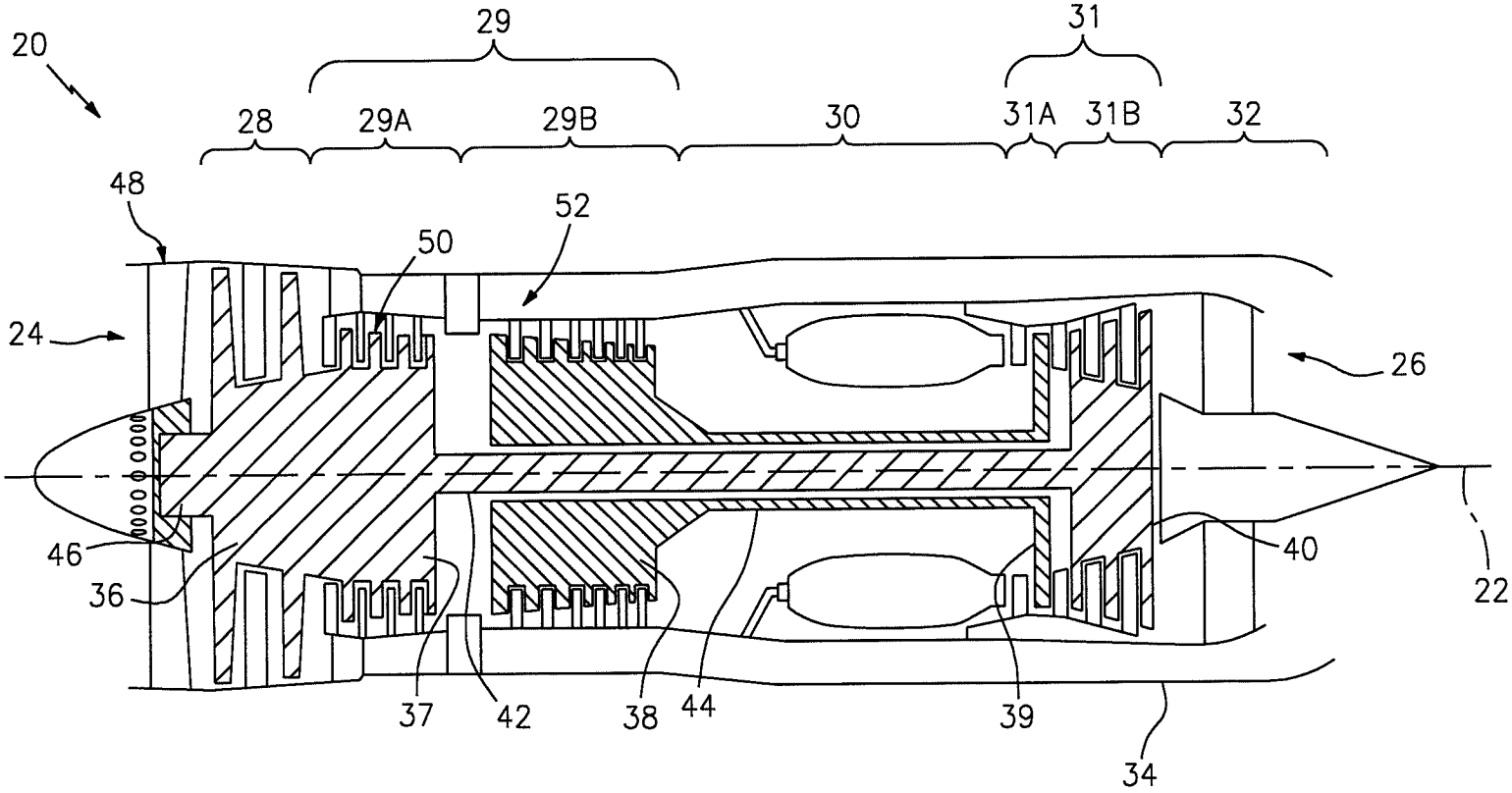
FIG. 1 is a side sectional illustration of a turbine engine.

FIG. 1 is a side sectional illustration of a turbine engine 20 that extends along an axis 22 between an upstream airflow inlet 24 and a downstream airflow exhaust 26. The engine 20 includes a fan section 28, a compressor section 29, a combustor section 30, a turbine section 31 and a nozzle section 32. The compressor section 29 includes a low pressure compressor (LPC) section 29A and a high pressure compressor (HPC) section 29B. The turbine section 31 includes a high pressure turbine (HPT) section 31A and a low pressure turbine (LPT) section 31B. The engine sections 28-32 are arranged sequentially along the axis 22 within an engine case 34.

Each of the engine sections 28, 29A, 29B, 31A and 31B includes a respective rotor 36-40. Each of the rotors 36-40 includes a plurality of rotor blades arranged circumferentially around and connected to (e.g., formed integral with or mechanically fastened, welded, brazed or otherwise adhered to) one or more respective rotor disks. The fan rotor 36 and the LPC rotor 37 are connected to and driven by the LPT rotor 40 through a low speed shaft 42. The HPC rotor 38 is connected to and driven by the HPT rotor 39 through a high speed shaft 44. The fan rotor 36 and the LPC rotor 37 are also connected to a forward shaft 46. The forward shaft 46 is rotatably supported by a turbine engine inlet assembly 48 that defines the airflow inlet 24.

Air enters the engine 20 through the inlet assembly 48, and is directed through the fan section 28 and into an annular core gas path 50 and an annular bypass gas path 52. The air within the core gas path 50 may be referred to as "core air". The air within the bypass gas path 52 may be referred to as "bypass air" or "cooling air". The core air is directed through the engine sections 29-32 and exits the engine 20 through the airflow exhaust 26. Within the combustor section 30, fuel is injected into and mixed with the core air and ignited to provide forward engine thrust. The bypass air is directed through the bypass gas path 52 and is utilized to cool various turbine engine components within one or more of the engine sections 29-32. The bypass air may also or alternatively be utilized to provide additional forward engine thrust.

Figure 2:
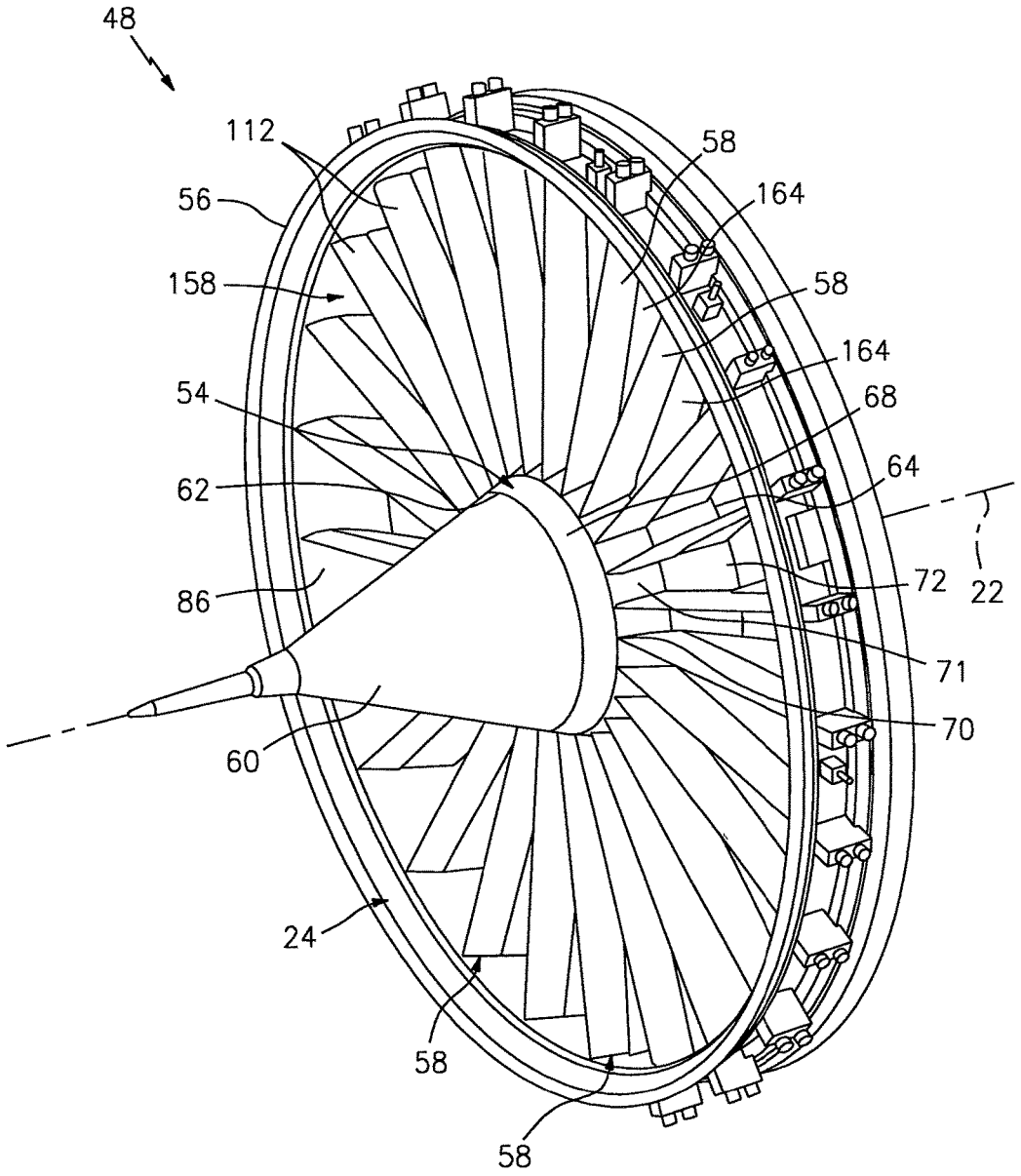
FIG. 2 is a perspective illustration of an inlet assembly for the engine of FIG. 1.
Figure 3:
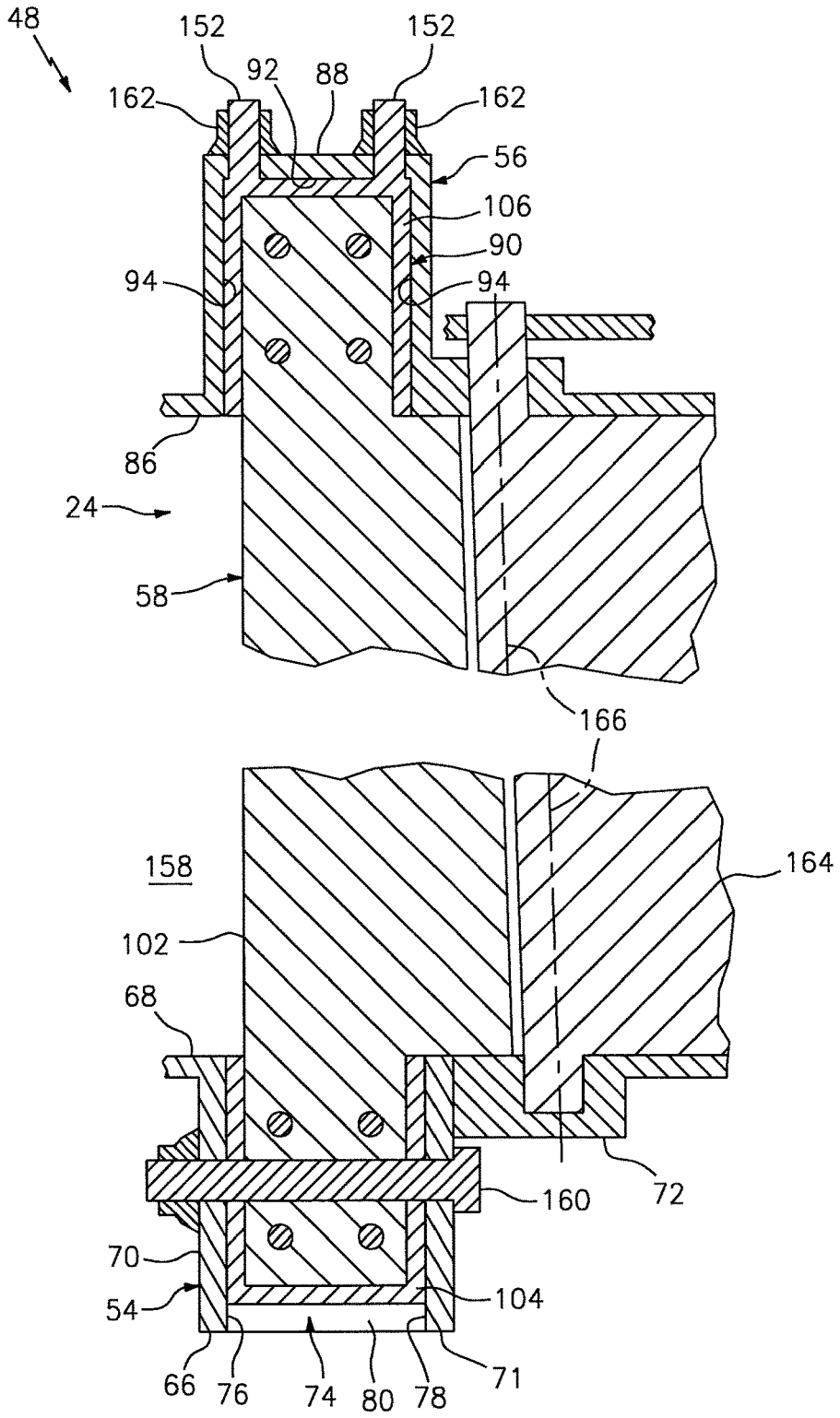
FIG. 3 is a side sectional illustration of a portion of the assembly of FIG. 2.

FIG. 2 is a perspective illustration of the inlet assembly 48. FIG. 3 is a side sectional illustration of a portion of the inlet assembly 48. Referring to FIGS. 2 and 3, the inlet assembly 48 includes a vane inner platform 54, a vane outer platform 56, a plurality of structural inlet guide vanes 58, and a nosecone 60.

The inner platform 54 extends circumferentially around the axis 22. The inner platform 54 extends axially between a platform upstream end 62 and a platform downstream end 64. The inner platform 54 extends radially between a platform inner side 66 and a platform outer side 68. The inner platform 54 includes one or more axial platform segments 70-72, and a plurality of vane apertures 74 (e.g., pockets or slots).

The platform segments may include an axial first segment 70 (e.g., an upstream ring), an axial second segment 71 (e.g., an intermediate ring), and an axial third segment 72 (e.g., a downstream ring). The first segment 70 extends axially from the upstream end 62 to the second segment 71. The second segment 71 is arranged and extends axially between the first segment 70 and the third segment 72. The third segment 72 extends axially between the second segment 71 and the downstream end 64.

Figure 4:
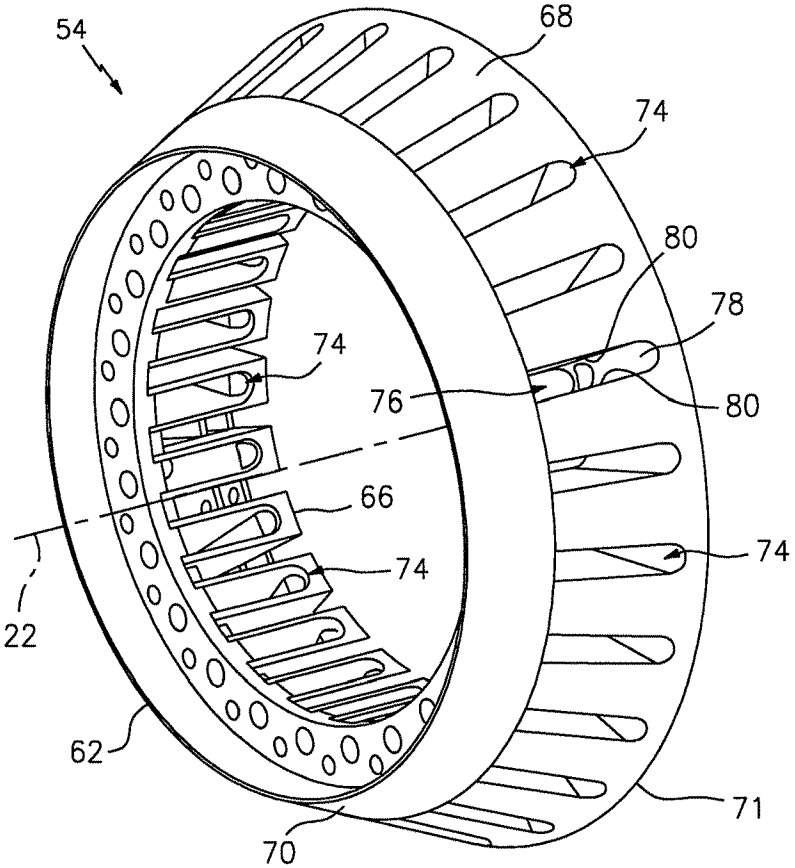
FIG. 4 is a perspective illustration of a portion of a vane inner platform for the assembly of FIG. 2.

Referring to FIG. 4, the vane apertures 74 are arranged circumferentially around the axis 22. One or more of the vane apertures 74 each extends radially through the inner platform 54 from the outer side 68 to the inner side 66. One or more of the vane apertures 74 each extends axially between opposing end surfaces 76 and 78. One or more of the vane apertures 74 each extends laterally (e.g., circumferentially or tangentially) between opposing side surfaces 80. One or more of the vane apertures 74 may each be defined by one or more of the platform segments; e.g., the first and the second segments 70 and 71. The first segment 70 includes, for example, the end surface 76. The second segment 71 includes the end surface 78 and the side surfaces 80.

Referring again to FIGS. 2 and 3, one or more of the platform segments 70-72 may each be cast, milled, machined and/or otherwise formed from metal. Examples of the metal may include titanium (Ti), aluminum (Al), nickel (Ni), or an alloy of one or more of the forgoing materials and/or any other material. Alternatively, the platform segments 70-72 may be formed from a composite. The inner platform 54, for course, may be constructed from various materials other than those set forth above.

Figure 5:
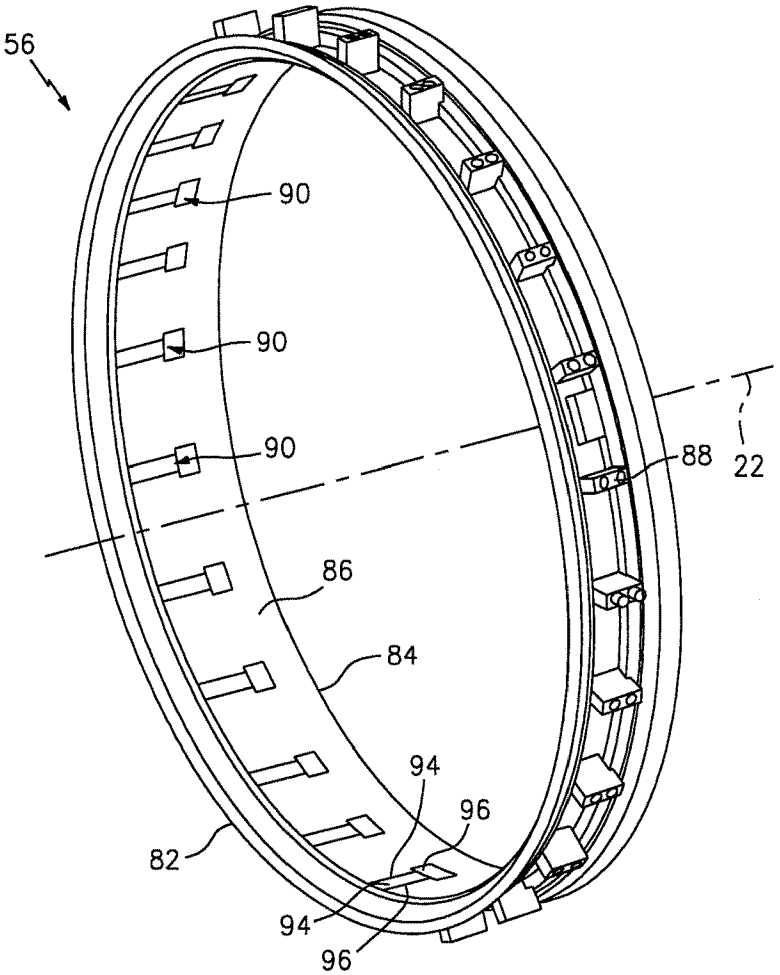
FIG. 5 is a perspective illustration of a vane outer platform for the assembly of FIG. 2.

Referring to FIG. 5, the outer platform 56 extends circumferentially around the axis 22. The outer platform 56 extends axially between a platform upstream end 82 and a platform downstream end 84. The outer platform 56 extends radially between a platform inner side 86 and a platform outer side 88. The outer platform 56 is configured as a unitary body, and includes a plurality of vane apertures 90 (e.g., pockets or slots).

The vane apertures 90 are arranged circumferentially around the axis 22. Referring to FIG. 3, one or more of the vane apertures 90 each extends radially into the outer platform 56 from the inner side 86 to a bottom surface 92. Referring again to FIG. 5, one or more of the vane apertures 90 each extends axially between opposing end surfaces 94. One or more of the vane apertures 90 each extends laterally between opposing side surfaces 96.

The outer platform 56 may be cast, milled, machined and/or otherwise formed from metal. Examples of the metal may include titanium (Ti), aluminum (Al), nickel (Ni), or an alloy of one or more of the forgoing materials. Alternatively, the outer platform 56 may be formed from a composite. The outer platform 56, for course, may be constructed from various materials other than those set forth above.

Figure 6:
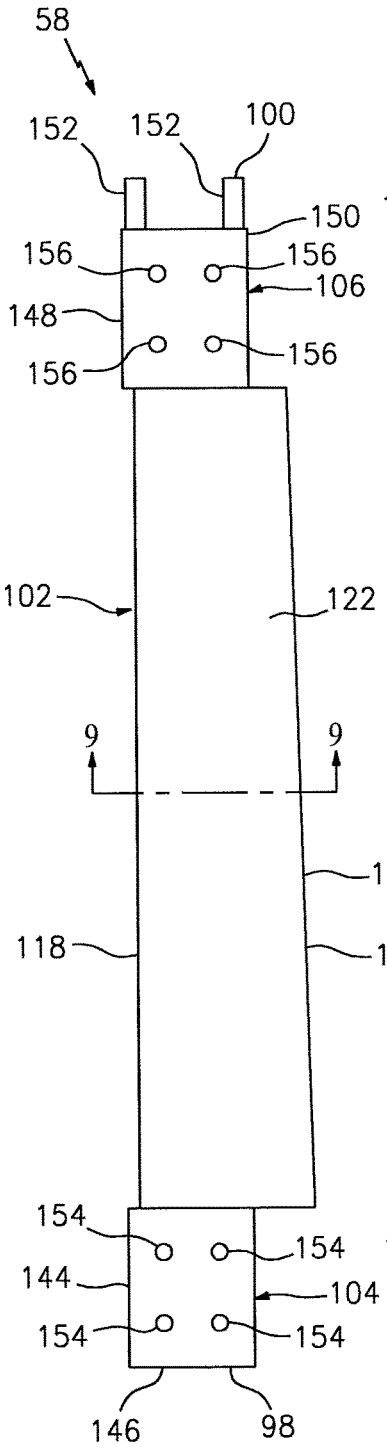
FIG. 6 is a side view illustration of a structural inlet guide vane for the assembly of FIG. 2.
Figure 7:
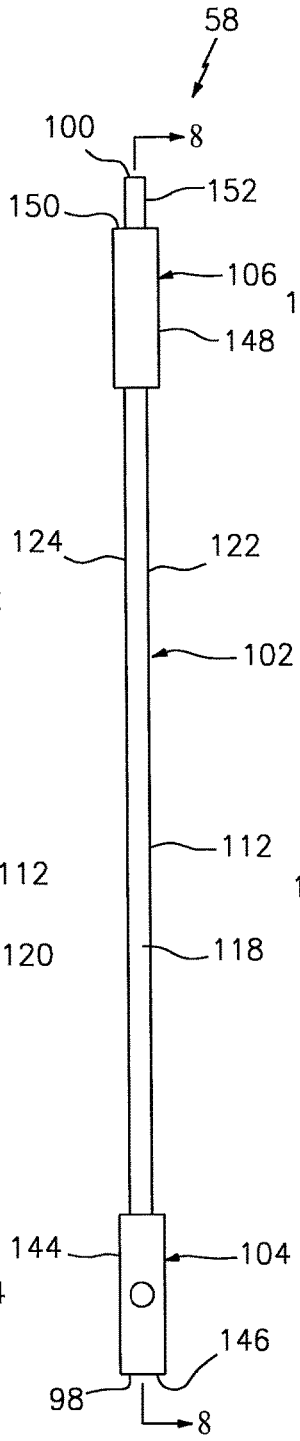
FIG. 7 is an upstream view illustration of the structural inlet guide vane of FIG. 6
Figure 8:
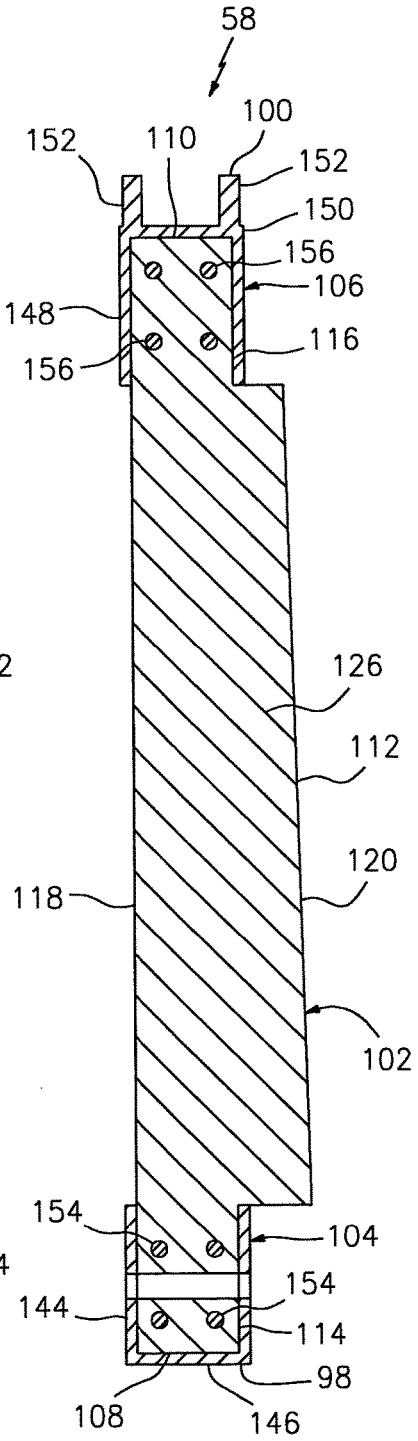
FIG. 8 is a side sectional illustration of the structural inlet guide vane of FIG. 7.

Referring to FIGS. 6 to 8, one or more of the structural inlet guide vanes 58 each extends radially between a body inner end 98 and a body outer end 100. One or more of the structural inlet guide vanes 58 each includes a structural vane body 102. One or more of the structural inlet guide vanes 58 may each also include one or more vane body mounts such as, for example, an inner mount 104 and an outer mount 106.

The structural vane body 102 extends radially between a body inner end 108 and a body outer end 110. The structural vane body 102 includes an airfoil portion 112, an inner mount portion 114 and an outer mount portion 116. The airfoil portion 112 is arranged and extends radially between the inner mount portion 114 and the outer mount portion 116. The airfoil portion 112 extends axially between an airfoil leading edge 118 and an airfoil trailing edge 120. The airfoil portion 112 extends laterally between opposing airfoil sides 122 and 124. The inner mount portion 114 extends radially from the airfoil portion 112 to the inner end 108. The outer mount portion 116 extends radially from the airfoil portion 112 to the outer end 110.

Figure 9:
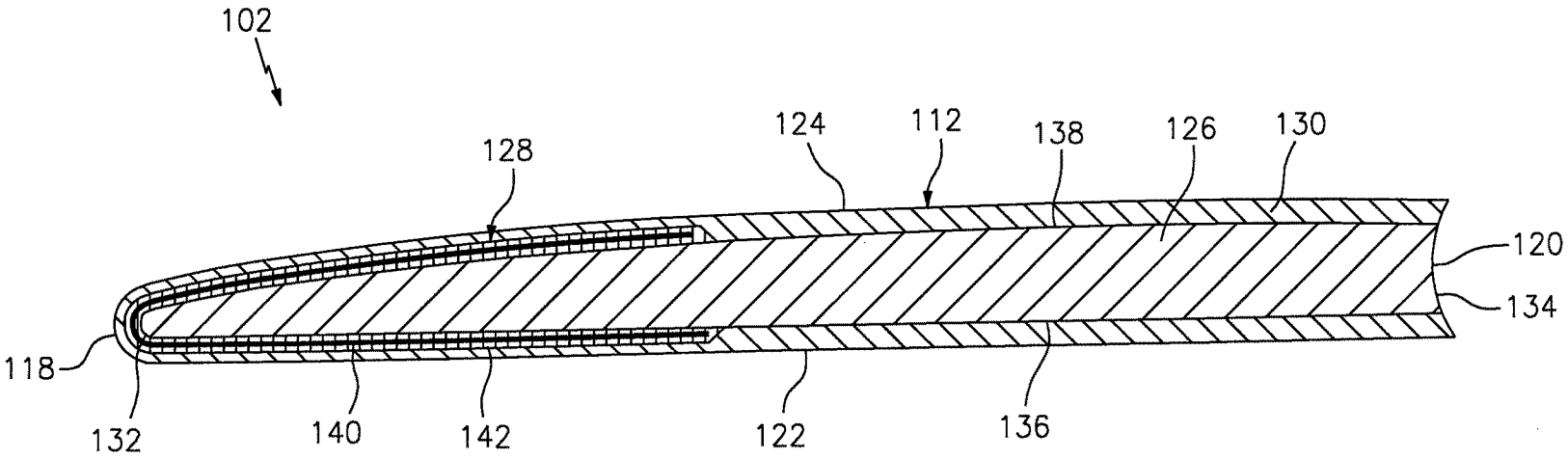
FIG. 9 is a cross-sectional illustration of the structural inlet guide vane of FIG. 6.

Referring to FIG. 9, the structural vane body 102 includes a core 126 (e.g., a solid core), a heater 128 and a coating 130. Referring to FIG. 8, the core 126 extends radially between the inner end 108 and the outer end 110. Referring again to FIG. 9, the core 126 extends axially between a core leading edge 132 and a core trailing edge 134. The core 126 extends laterally between opposing core sides 136 and 138. The core 126 is compression molded and/or otherwise formed from an organic matrix composite (OMC). The organic matrix composite may include graphite, silicon carbide, fiberglass, etc. The organic matrix composite, of course, may also or alternatively include various materials other than those set forth above.

The heater 128 is located at (e.g., on, adjacent or proximate) the airfoil leading edge 118, and is connected to the core 126. The heater 128 is, for example, adhered and/or otherwise bonded to the core leading edge 132, at least an upstream portion of the core side 136 and/or at least an upstream portion of the core side 138. The heater 128 includes a heating element 140 (e.g., a metallic wire and/or film) that is completely (or at least partially) embedded within an insulator 142 such as, for example, fiberglass. The heater 128, of course, may have various configurations other than that described above.

The coating 130 at least partially coats the core 126 and/or the heater 128. The coating 130 is coated onto, for example, the heater 128 as well as portions of the core side surfaces 136 and 138 that are not covered by the heater 128. The core trailing edge 134 is uncoated. Alternatively, the core trailing edge may also be coated with the coating 130 or another coating. The coating 130 may be an erosion coating such as, for example, a polyurethane coating, a silicon coating and/or a fluoroelastomer coating (e.g., a Viton® coating manufactured by DuPont of Wilmington, Del.). The coating 130 alternatively may be various types of coatings other than an erosion coating.

Referring to FIGS. 6 to 8, the inner mount 104 includes a tubular sleeve 144 and a base 146. The sleeve 144 may be configured integral with the base 146; e.g., formed as a unitary body. The sleeve 144 extends radially outwards from the base 146. The inner mount 104 may be cast, milled, machined and/or otherwise formed from metal. Examples of the metal may include titanium (Ti), aluminum (Al), nickel (Ni), or an alloy of one or more of the forgoing materials and/or any other material. Alternatively, the inner mount 104 may be formed from a composite. The inner mount 104, for course, may be constructed from various materials other than those set forth above.

The outer mount 106 includes a tubular sleeve 148, a base 150, and one or more fasteners 152 (e.g., threaded studs). The sleeve 148 and/or one or more of the fasteners 152 may be configured integral with the base 150; e.g., formed as a unitary body. The sleeve 148 extends radially inwards from the base 150. The fasteners 152 extend radially outwards from the base 150. The outer mount 106 may be cast, milled, machined and/or otherwise formed from metal. Examples of the metal may include titanium (Ti), aluminum (Al), nickel (Ni), or an alloy of one or more of the forgoing materials and/or any other material. Alternatively, the outer mount 106 may be formed from a composite. The outer mount 106, for course, may be constructed from various materials other than those set forth above.

Referring to FIGS. 6 to 8, the structural vane body 102 is mated with the inner mount 104 and the outer mount 106. The inner mount portion 114 extends radially into the sleeve 144, and the body inner end 108 engages (e.g., contacts) the base 146. The inner mount portion 114 is adhered and/or otherwise bonded to the inner mount 104. The inner mount portion 114 is also (or alternatively) mechanically fastened to the inner mount 104 with one or more fasteners 154 (e.g., rivets). The outer mount portion 116 extends radially into the sleeve 148, and the body outer end 110 engages the base 150. The outer mount portion 116 is adhered and/or otherwise bonded to the outer mount 106. The outer mount portion 116 is also (or alternatively) mechanically fastened to the outer mount 106 with one or more fasteners 156 (e.g., rivets).

Referring to FIG. 2, the nosecone 60 is connected (e.g., mechanically fastened) to the first segment 70. The inner platform 54 is arranged radially within the outer platform 56, which defines an inlet gas path 158 of the engine 20 between the platform outer side 68 and the platform inner side 86. The structural inlet guide vanes 58 are arranged circumferentially around the axis 22. The airfoil portions 112 extend radially through the inlet gas path 158 between the inner platform 54 and the outer platform 56.

Referring to FIG. 3, each structural inlet guide vane 58 is mated with a respective one of the vane apertures 74 and a respective one of the vane apertures 90. The inner mount 104 extends radially into the respective vane aperture 74. The inner mount 104 is connected to the first segment 70 and the second segment 71 with at least one fastener 160 (e.g., a bolt and a nut). The fastener 160 also connects the first segment 70 to the second segment 71. The third segment 72 may be connected to the second segment 71 with one or more additional fasteners (not shown). The outer mount 106 extends radially into the respective vane aperture 90. The outer mount 106 is connected to the outer platform 56 with the fasteners 152. The fasteners 152, for example, extend radially through the outer platform 56 and are respectively mated with one or more nuts 162. In this manner, the structural inlet guide vanes 58 structurally connect the inner platform 54 as well as the shaft 46 (see FIG. 1) to the outer platform 56.

During operation of the engine 20, the structural inlet guide vanes 58 transfer loads between the inner platform 54 and the outer platform 56. Each of the structural inlet guide vanes 58 and, more particularly, each of the structural vane bodies 102 also guides the flow of air from the airflow inlet 24 through the gas path 158 and into the fan section 28 (see FIG. 1).

Referring to FIG. 2, the inlet assembly 48 also includes a plurality of adjustable inlet guide vanes 164 that are respectively arranged with the structural inlet guide vanes 58. Each of the adjustable inlet guide vanes 164 is respectively circumferentially aligned with a respective one of the structural inlet guide vanes 58. Each of the adjustable inlet guide vanes 164 is respectively is located adjacent to and downstream of a respective one of the structural inlet guide vanes 58. Referring to FIG. 3, each of the adjustable inlet guide vanes 164 is connected to the inner platform 54 and the outer platform 56. Each of the adjustable inlet guide vanes 164 is rotatable about a respective radially extending axis 166. During engine operation, one or more of the adjustable inlet guide vanes 164 may each be rotated about its axis 166 to adjust the amount of air flowing into the fan section 28 (see FIG. 1).

Figure 10:
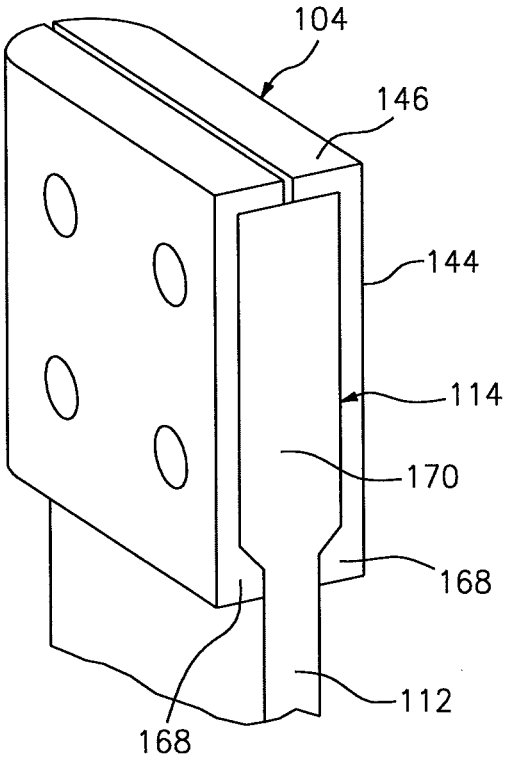
FIG. 10 is a perspective illustration of a portion of another structural inlet guide vane.

The inlet assembly 48 and the inlet assembly components may have various configurations other than those described above and illustrated in the drawings. The inlet assembly 48, for example, may be configured without one or more of the adjustable inlet guide vanes 164. One or more of the vane apertures 74 may each extend partially radially into the inner platform 54 from the platform outer side 68. The inner platform 54 may be configured as a unitary body. The outer platform 56 may be configured with a plurality of axial segments. Referring to FIG. 10, the inner mount 104 (or the outer mount 106) may include one or more flanges 168 that radially engage a laterally flared portion 170 of the inner mount portion 114 (or the outer mount portion 116). The present invention therefore is not limited to any particular inlet assembly or inlet assembly component types or configurations.

The terms "upstream", "downstream", "inner" and "outer" are used to orientate the components of the inlet assembly 48 described above relative to the turbine engine 20 and its axis 22. A person of skill in the art will recognize, however, one or more of these components may be utilized in other orientations than those described above. The present invention therefore is not limited to any particular spatial orientations.

A person of skill in the art will recognize the inlet assembly 48 may be included in various turbine engines other than the one described above. The inlet assembly, for example, may be included in a geared turbine engine where a gear train connects one or more shafts to one or more rotors in a fan section, a compressor section and/or any other engine section. Alternatively, the inlet assembly may be included in a turbine engine configured without a gear train. The inlet assembly may be included in a geared or non-geared turbine engine configured with a single spool, with two spools (e.g., see FIG. 1), or with more than two spools. The present invention therefore is not limited to any particular types or configurations of turbine engines.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined within any one of the aspects and remain within the scope of the invention. Accordingly, the present invention is not to be restricted except in light of the attached claims and their equivalents.

What is claimed is:

1. An assembly for a turbine engine, comprising:
an inner platform;
an outer platform that circumscribes the inner platform; and
a plurality of structural inlet guide vanes arranged around an axis, and extending radially between and connected to the inner platform and the outer platform;
wherein a first of the structural inlet guide vanes includes a structural vane body comprising an organic matrix composite;
wherein the structural vane body includes a core of the organic matrix composite; and
wherein the structural vane body further includes a coating that at least partially coats the core and forms an outermost aerodynamic surface of the structural inlet guide vanes.

2. The assembly of claim 1, wherein
the structural vane body transfers loads between and structurally ties the inner platform and the outer platform;
a gas path is defined radially between the inner platform and the outer platform; and
the structural vane body guides gas through the gas path.

3. The assembly claim 1, wherein the core comprises a substantially solid core of the organic matrix composite.

4. The assembly of claim 1, wherein
the structural vane body extends axially between a leading edge and a trailing edge; and
the structural vane body further includes a heater located at the leading edge and connected to the core.

5. The assembly of claim 4, wherein the heater includes a heating element that is at least partially embedded within an insulator.

6. The assembly of claim 4, wherein the structural vane body further includes a coating that at least partially coats the heater.

7. The assembly of claim 1, wherein
the structural vane body extends axially between a leading edge and a trailing edge; and
the structural vane body includes a heater located at the leading edge.

8. The assembly of claim 1, wherein the first of the structural inlet guide vanes further includes a mount that fastens the structural vane body to one of the inner platform and the outer platform.

9. The assembly of claim 8, wherein
the structural vane body extends radially between inner end and an outer end; and
the mount includes a sleeve; and
the structural vane body extends radially into and is at least one of fastened and adhered to the sleeve.

10. The assembly of claim 9, wherein the sleeve comprises metal.

11. The assembly of claim 1, wherein
the outer platform includes a vane aperture; and
the first of the structural inlet guide vanes extends radially into the vane aperture.

12. The assembly of claim 1, wherein
the inner platform includes a vane aperture; and
the first of the structural inlet guide vanes extends radially into the vane aperture.

13. The assembly of claim 12, wherein
the inner vane platform includes an axial first segment and an axial second segment that is fastened to the first segment; and
the vane aperture is defined by the first segment and the second segment.

14. The assembly of claim 1, wherein the organic matrix composite comprises at least one of graphite, silicon carbide and fiberglass.

15. The assembly of claim 1, wherein at least one of the inner platform and the outer platform comprises metal.

16. The assembly of claim 1, further comprising a nosecone connected to the inner platform.

17. The assembly of claim 1, further comprising:
a plurality of adjustable inlet guide vanes respectively arranged with the structural inlet guide vanes;
wherein each of the adjustable inlet guide vanes rotates about a respective radially extending axis.

18. The assembly of claim 1, wherein the structural vane body has a leading edge and a trailing edge, and the structural vane body is a solid body that extends between the leading edge and the trailing edge.

19. An assembly for a turbine engine, comprising:
an inner platform;
an outer platform circumscribing the inner platform; and
a plurality of structural inlet guide vanes arranged around an axis, and extending radially between and connected to the inner platform and the outer platform;
wherein a first of the structural inlet guide vanes includes a structural vane body comprising an organic matrix composite;
wherein the structural vane body includes a core of the organic matrix composite; and
wherein the core has a tapered leading edge and a trailing edge, and the core is a solid body that extends between the leading edge and the trailing edge.

* * * * *